US009839800B2

(12) United States Patent
Fukuda et al.

(10) Patent No.: US 9,839,800 B2
(45) Date of Patent: Dec. 12, 2017

(54) METHOD FOR PREVENTING AND EXTINGUISHING FIRE

(71) Applicants: YAMATO PROTEC CORPORATION, Osaka-shi, Osaka (JP); NIPPON ALUMINUM ALKYLS, LTD., Tokyo (JP)

(72) Inventors: Yasuyoshi Fukuda, Sakai (JP); Yuki Takatsuka, Sakai (JP); Takahiro Ishihara, Inashiki-gun (JP); Koki Fukumura, Takaishi (JP); Seijiro Koga, Takaishi (JP); Koji Miyashita, Takaishi (JP)

(73) Assignee: YAMATO PROTEC CORPORATION, Osaka-shi (JP)

( * ) Notice: Subject to any disclaimer, the term of this patent is extended or adjusted under 35 U.S.C. 154(b) by 0 days.

(21) Appl. No.: 14/777,101

(22) PCT Filed: Feb. 19, 2014

(86) PCT No.: PCT/JP2014/000865
§ 371 (c)(1),
(2) Date: Sep. 15, 2015

(87) PCT Pub. No.: WO2014/132596
PCT Pub. Date: Sep. 4, 2014

(65) Prior Publication Data

US 2016/0023025 A1 Jan. 28, 2016

(30) Foreign Application Priority Data

Mar. 1, 2013 (JP) ..... 2013-041311

(51) Int. Cl.
*A62C 3/06* (2006.01)
*A62D 1/02* (2006.01)
(Continued)

(52) U.S. Cl.
CPC ..... *A62C 3/06* (2013.01); *A62C 5/02* (2013.01); *A62D 1/0071* (2013.01); *A62C 99/0036* (2013.01)

(58) Field of Classification Search
CPC ..... A62C 3/06; A62C 3/065; A62C 99/0009; A62C 99/0036; A62D 1/0071; A62D 1/0078; A62D 3/00
See application file for complete search history.

(56) References Cited

U.S. PATENT DOCUMENTS 3,677,347 A * 7/1972 Rosen ..... A62D 1/0071 169/44
5,026,735 A * 6/1991 Stern ..... A62D 1/0071 252/3

(Continued)

*Primary Examiner* — Ryan A Reis
(74) *Attorney, Agent, or Firm* — Westerman, Hattori, Daniels & Adrian, LLP

(57) ABSTRACT

The present invention provides a method for preventing and extinguishing fire, the method for preventing and extinguishing fire being effective against fire caused by a pyrophoric material and a water prohibitive substance. The method for preventing and extinguishing fire of the present invention is characterized in that a fire extinguishing foam composition is supplied to a flame caused by the combustion of a pyrophoric material and a water prohibitive substance whereby the flame is suppressed or extinguished, and that a combustible material is changed to an inert substance by a hydration reaction, the combustible material being a pyrophoric material or a water prohibitive substance.

4 Claims, 1 Drawing Sheet

(51) Int. Cl.
*A62C 5/02* (2006.01)
*A62C 99/00* (2010.01)

(56) References Cited

U.S. PATENT DOCUMENTS 5,124,363 A * 6/1992 Stern ..... A62D 1/0071 252/3
6,262,128 B1 * 7/2001 Stern ..... A62D 1/0085 169/45
6,495,056 B2 * 12/2002 Kubo ..... A62D 1/0078 252/2
2009/0071662 A1 * 3/2009 Popp ..... A62C 5/02 169/46

* cited by examiner

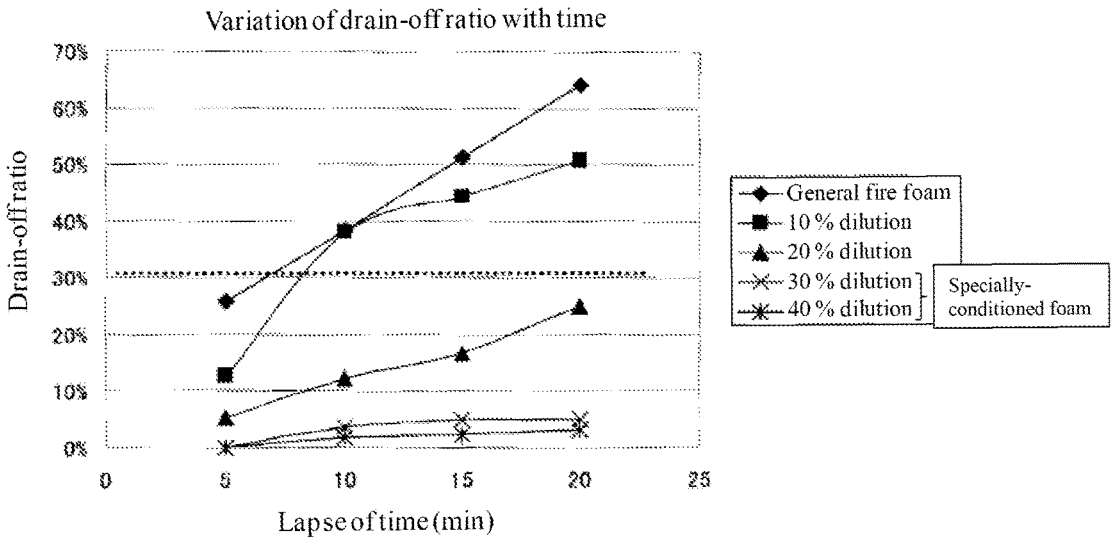
Variation of drain-off ratio with time
70%
60%
50%
40%
30%
20%
10%
0%
Drain-off ratio
0
5
10
15
20
25
Lapse of time (min)
General fire foam
10 % dilution
20 % dilution
30 % dilution
40 % dilution
Specially-conditioned foam

METHOD FOR PREVENTING AND EXTINGUISHING FIRE

TECHNICAL FIELD

The present invention relates to a method for preventing and extinguishing fire to be conducted when organic metallic compounds and metal hydrides having spontaneous combustibility and/or a water prohibitive property leak or cause fire.

BACKGROUND TECHNOLOGY

Hazardous materials having spontaneous combustibility or a water prohibitive property are categorized as pyrophoric substances or water prohibitive substances in Class 3 according to the Fire Service Act Article 2 Paragraph 7, respectively. Then, standards of fire extinguishing equipment against these hazardous materials are categorized and stipulated according to Article 20 of Non-Patent Literature 1 (Article 20 of Hazardous Materials Control Order (government ordinance No. 306 of Sep. 26, 1959)).

Specifically, fire-extinguishing equipment, a fire extinguisher that emits fire-extinguishing powder and the like are exemplified, and as materials for fire extinction (fire-extinguishing agents), for example, hydrogen carbonates, drying sand, Dilatable vermiculite, Dilatable perlite and the like are categorized and mentioned.

PRIOR ART LITERATURE

Non-Patent Literature

Non-Patent Literature: Article 20 of Hazardous Materials Control Order (government ordinance No. 306 of Sep. 26, 1959)

SUMMARY OF THE INVENTION

Problem to be Solved by the Invention

However, even if a material for fire extinction described in the Non-Patent Literature 1 is used, this is not always sufficient in a point of fire-extinguishing performance against pyrophoric substances or water prohibitive substances, and there is still room for improvement.

In other words, the objective of the present invention is to provide a method for preventing and extinguishing fire, which is effective against fire caused by pyrophoric substances and water prohibitive substances.

Means for Solving the Problem

For the purpose of solving the problem above, as a result of keenly repeating experiments for studying, by the inventors of the present application, in order to effectively prevent/extinguish fire due to pyrophoric substances or water prohibitive substances, they have discovered that a supply of A fire-extinguishing foam composition is effective, and completed the present invention.

In other words, the present invention relates to a method for preventing and extinguishing fire that is characterized such that a supply of a fire-extinguishing foam composition to a fire due to by pyrophoric substances or water prohibitive substances results in controlling/extinguishing the fire, and, combustible materials, which are pyrophoric substances or water prohibitive substances, are converted into an inert material by hydration reaction.

According to the method for preventing and extinguishing fire of the present invention having such configuration, while a temperature increase of combustible materials is controlled due to latent heat of vaporization of water composing foam of a fire-extinguishing agent composition, a fire by burning of pyrophoric substances or water prohibitive substances is smothered for controlling or extinguishing the fire, and, combustible materials, which are pyrophoric substances or water prohibitive substances, (including pyrophoric substances and water prohibitive substances, and at least a part of these are chemically altered) are converted into inert substances due to hydration reaction and fire control/fire-extinguishing can be realized.

In the method for preventing and extinguishing fire of the present invention, the pyrophoric substances or the water prohibitive substances are preferably organic metallic compounds or metal hydrides having spontaneously combustibility or a water prohibitive property, or a composition containing those.

According to the method for preventing and extinguishing fire of the present invention having such configuration, foam of the fire-extinguishing agent composition does not easily turn back into water solution (difficult to be defoamed), and a fire due to combustion of a pyrophoric substance or a water prohibitive substance is certainly smothered for preventing or extinguishing the fire, and, a combustible material, which is a pyrophoric substance or a water prohibitive substance, can be converted into an inert substance due to hydration reaction.

In the method for preventing and extinguishing fire of the present invention, it is preferable that the fire-extinguishing agent composition can generate foam where its drain-off ratio twenty (20) minutes later is 30% or less. In addition, in the method for preventing and extinguishing fire of the present invention, it is particularly preferable that the fire-extinguishing agent composition can generate foam where its drain-off ratio twenty (20) minutes later is 25% or less, and particularly 5% or less of foam.

According to the method for preventing and extinguishing fire of the present invention having such configuration, foam of the fire-extinguishing agent composition does not easily turn back into water solution (difficult to be defoamed), and more certainly, a fire due to the combustion of a pyrophoric substance or a water prohibitive substances is smothered for controlling or extinguishing the fire, and, a combustible material, which is a pyrophoric substance or a water prohibitive substance, can be converted into an inert substance due to hydration reaction.

In the method for preventing and extinguishing fire of the present invention, the temperature of the pyrophoric substance or water prohibitive substance after the supply of the fire-extinguishing agent composition is preferably 100° C. or less. According to the method for preventing and extinguishing fire of the present invention having such configuration, fire prevention and fire extinction can be more certainly and more safely realized.

Effect of the Invention

According to the present invention, an effective method for preventing and extinguishing fire against a fire caused by a pyrophoric substance and a water prohibitive substance can be provided.

BRIEF DESCRIPTION OF DRAWING

FIG. 1 is a graph where a variation of drain-off ratios of "specially-conditioned foam" with time is plotted.

BEST MODE FOR CARRYING OUT THE INVENTION

The method for preventing and extinguishing fire of the present invention is characterized such that a supply of a fire-extinguishing foam composition to a fire due to combustion of a pyrophoric substance or a water prohibitive substance results in controlling or extinguishing the fire, and, the pyrophoric substance or water prohibitive substance is converted into an inert substance.

Herein, the pyrophoric substances or water prohibitive substances (substances having spontaneous combustibility and/or water prohibitive property) subject to the method for preventing and extinguishing fire of the present invention are explained.

The substance having spontaneously combustibility and/or a water prohibitive property in the present invention is, first, an organic metallic compound and a metal hydride having spontaneously combustibility and/or a water prohibitive property, or a compound containing these.

As the organic metallic compound, for example, alkylaluminum compounds, alkyl and/or aryllithium compounds, alkyl boron compounds, alkygallium compounds, alkyl indium compounds, alkylzinc compounds and alkyl magnesium compounds and the like are exemplified, and one of these or any combination is also acceptable.

Further, as the metal hydride above, for example, alkali metal hydride, alkaline-earth metal hydride, aluminum hydride, boron hydride, alkali metal salts of aluminum hydride, alkali metal salt of boron hydride and the like are exemplified, and one of these or any combination is also acceptable.

(1) Alkylaluminum Compounds

As the alkylaluminum compounds, for example, the following compounds are exemplified:

(1-1) Tri-Alkylaluminum

Trimethylaluminium, triethylaluminium, tri-n-propylaluminum, tri-n-butylaluminum, tri-isobutylaluminum, tri-n-pentylaluminum, tri-n-hexylaluminum, tri-n-heptylaluminum, tri-n-octylaluminum, tri-n-octylaluminum, tri-n-nonylaluminum, tri-n-decylaluminum, tri-n-dodecylaluminum, tri-n-undecylaluminum and the like (1-2) Alkylaluminum Hydrides Dimethylaluminum hydride, diethylaluminum hydride, diidobutylaluminum hydride and the like (1-3) Alkylaluminum Hydride Dimethylaluminum fluoride, dimethylaluminum chloride, dimethylaluminum bromide, dimethylaluminum iodide, methylaluminum sesquichloride, methylaluminum sesquibromide, methylaluminum dichloride, methylaluminum dibromide, diethylaluminum fluoride, diethylaluminum chloride, diethylaluminum bromide, diethylaluminum iodide, ethylaluminum sesquichloride, ethylaluminum sesquibromide, ethylaluminum dichloride, ethylaluminum dibromide, dipropyl aluminum chloride, dipropyl aluminum bromide, di-n-butylaluminum chloride, di-n-butylaluminum bromide, diisobutylaluminum chloride, diisobutylaluminum bromide and the like (1-4) Alkylaluminum Derivative Dimethylaluminum methoxide, dimethylaluminum ethoxide, diethylaluminum methoxide, diethylaluminum ethoxide, diethylaluminum phenate, ethylaluminum diphenate, ethylbis (2,6-di-t-butylphenoxy) aluminum, ethylbis (2,6-di-t-butyl-4-methylphenoxy) aluminum, isobutylbis (2,6-di-t-butyl-4-methylphenoxy) aluminum, methylaluminoxane, ethylaluminoxane, butyl aluminoxane, dimethyl (dim ethylamino) aluminum, diethyl (di methylamino) aluminum, and the like (2) Alkyl and/or Aryllithium Compound As the alkyl and/or aryllithium compounds are, for example, the following compounds are exemplified:

Methyllithium, ethyllithium, n-propyllithium, n-butyllithium, sec-butyllithium, tert-butyllithium, phenyllithium, 4-methyl phenyllithium, 1-naphtyllithium, 2-trifluoromethyl naphtyllithium, and the like (3) Alkyl Boron Compound As the alkyl boron compounds, for example, the following compounds are exemplified:

Trimethylborane, triethylborane, tri-n-propylborane, tri-n-butylborane, tri-isobutylborane, tri-n-pentylborane, tri-n-hexylborane, tri-n-heptylborane, tri-n-octylborane, tri-n-octylborane, di-n-butylborane, dicyclohexyl borane, diethyl (methoxy) borane, di-n-butyl (n-butoxy) borane, chloro (diethyl) borane, chloro (di-tert-butyl) borane (4) Alkygallium Compound As the alkygallium compounds, for example, the following compounds are exemplified:

Trimethyl gallium, triethyl gallium, tri-n-propyl gallium, tri-n-butyl gallium, dimethyl galliumchloride, diethylgalliumchloride, diethylgalliumbromide and, the like (5) Alkyl Indium Compound As the alkyl indium compounds, the following compounds are exemplified:

Trimethyl indium, triethyl indium, tri-n-propyl indium, tri-n-butylindium, dimethyl indium chloride, diethylindium chloride, diethylindium bromide, and the like (6) Alkylzinc Compound As the alkylzinc compounds, the following compounds are exemplified:

Dimethyl zinc, diethylzinc, di-n-propyl zinc, di-n-butyl zinc, diisobutyl zinc, di-n-pentyl zinc, di-n-hexyl zinc, dicyclohexyl zinc, and the like (7) Alkyl Magnesium Compound As the alkyl magnesium compounds, the following compounds are exemplified:

Dimethyl magnesium, diethyl magnesium, di-n-propyl magnesium, di-n-butyl magnesium, di-sec-butyl magnesium, di-tert-butyl magnesium, ethyl methyl magnesium, n-butyl ethyl magnesium, methyl magnesium bromide, methyl magnesium chloride, ethyl magnesium bromide, ethyl magnesium chloride, n-propyl magnesium bromide, n-butylmagnesium chloride, sec-butylmagnesium bromide, tert-butylmagnesium bromide, and the like (8) Alkali Metal Hydride As the alkali metal hydrides, the following compounds are exemplified:

Lithium hydride, sodium hydride, potassium hydride, and the like (9) Alkaline-Earth Metal Hydride As the alkaline-earth metal hydrides, the following compounds are exemplified: Calcium hydride, barium hydride, and the like

(10) Aluminum Hydride

As the aluminum hydrides, the following compounds are exemplified: Alane, alane trimethylamine complex, alane dimethylethylamine complex and the like

(11) Boron Hydride

As the boron hydrides, the following compounds are exemplified:

Borane tetrahydro tetrahydrofuran complex, borne dimethylsulfide complex, borane pyridine complex, borane triethylamine complex, borane dimethylamine complex, and the like

(12) Alkali Metal Salts of Aluminum Hydride

As alkali metal salts of the aluminum hydrides, the following compounds are exemplified:

Lithium aluminum hydride, sodium aluminum hydride, potassium aluminum hydride, sodium bis (2-methoxyethoxy) aluminum hydride, and the like

(13) Alkali Metal Salts of Boron Hydride

As alkali metal slats of the boron hydride, the following compounds are exemplified:

Lithium boron hydride, sodium boron hydride, potassium boron hydride, sodium cyano boron hydride, and the like Further, as the water prohibitive substances, for example, such as metallic lithium, metallic sodium, metallic sodium or metallic sodium, and compositions containing these are exemplified.

Next, as the method for preventing and extinguishing fire of the present invention, a fire-extinguishing foam composition is supplied to a fire due to burning of the pyrophoric substance or water prohibitive substance. As the fire-extinguishing agent composition used here, conventionally-known fire-extinguishing agent compositions can be used, and these should be fire-extinguishing agent compositions having a common composition, including, for example, protein hydrolysate, glycol, surfactant and water.

However, the fire-extinguishing agent composition in the present invention can generate foam with a slow drain-off rate (specially-conditioned foam). For this "specially-conditioned foam", foam is turned back into original foam solution immediately after foam formation. This reduction rate is regarded as one of the criteria for foam stability. In other words, fire-extinguishing agent composition in the present invention has a slow drain-off rate, and it is difficult to be turned back into the foam to a liquid (water solution). Among them, it is preferable to have foam with 30% or less of the drain-off ratio twenty (20) minutes later.

Here, typifying alkylaluminum, chemical properties of substances having spontaneously combustibility and/or a water prohibitive property targeting at the method for preventing and extinguishing fire of the present invention are explained below.

In general, alkylaluminum is unstable at higher temperature and is broken down at 200° C. or higher of temperature, and metallic aluminum, olefin and hydrogen are generated. In other words, a broken down reaction occurs.

$$(CnH_{2n+1})_3Al \rightarrow (CnH_{2n+1})_2AlH + CnH_{2n}$$

$$(CnH_{2n+1})_2AlH \rightarrow Al + 3/2H_2 + 2CnH_{2n}$$

Further, an oxidation reaction of alkylaluminum is a great exothermic reaction, and when alkylaluminum with C4 or less makes contact with air, it ignites spontaneously. In other words, an oxidation reaction occurs.

$$2(CnH_{2n+1})_3Al + 3(3n+1)O_2 \rightarrow 6nCO_2 + Al_2O_3 + 3(2n+1)H_2O$$

$$2(CnH_{2n+1})_2AlCl + 2(3n+1)O_2 \rightarrow 4nCO_2 + Al_2O_3 + 2HCl + (4n+1)H_2O$$

Then, because alkylaluminum intensely reacts with water and instantaneously emits reaction energy, it is explosive and saturated hydrocarbon is generated. In other words, a hydration reaction occurs.

$$(CnH_{2n+1})_3Al + 3H_2O \rightarrow Al(OH)_3 \pm 3CnH_{2n+1}$$

$$(CnH_{2n+1})_2AlCl + 6H_2O \rightarrow 2Al(OH)_3 + 6CnH_{2n+1} + AlCl_3$$

In the method for preventing and extinguishing fire of the present invention, while a temperature rise of a combustible material is controlled due to latent heat of vaporization of water composing foam of the fire-extinguishing agent composition, burning (i.e., the broken down reaction and oxidation reaction) of a pyrophoric substance or a water prohibitive substance due to the foam, and, the combustible material, which is a pyrophoric substance or a water prohibitive substance, is converted into an inert substance due to a hydration reaction, and fire prevention and fire extinction are accelerated. In other words, a pyrophoric substance or a water prohibitive substance is safely burned up in association with the hydration reaction.

To be more specific, a supply of "specially-conditioned foam" with a lower reduction rate to burning alkylaluminum enables to be slowly (safely) broken down to $Al(OH)_3$ and saturated hydrocarbon due to a foam solution turned back from foam while an oxygen supply to burning alkylaluminum is blocked and a fire is extinguished.

Although this breakdown reaction is an exothermic reaction, temperature can be maintained at 100° C. due to latent heat of vaporization of water in the foam. Therefore, since alkylaluminum is all broken down to $Al(OH)_3$ after fire extinction, there is no risk of secondary disaster.

Herein, actually-measured examples of drain-off ratios of "specially-conditioned foam" over time are shown in Table 1, and FIG. 1 shows that these are plotted into a graph. Among them, foam with 25% or less of the drain-off ratio twenty (20) minutes later is appropriate. Furthermore, since foam properties, such as a reduction rate or an expansion ratio, are determined according to performance of both a foam solution (foam liquid concentrate), the fire-extinguishing agent composition in the present invention can be prepared so as to appropriately have "specially-conditioned foam" due to the composition (for example, an amount of water) and a foaming apparatus.

TABLE 1

| Lapse of time (min) | General fire foam | 10% dilution | 20% dilution | 30% dilution | 40% dilution |
|---|---|---|---|---|---|
| 5 | 25.7% | 12.7% | 5.4% | 0.0% | 0.0% |
| 10 | 38.6% | 38.2% | 12.1% | 3.7% | 1.9% |
| 15 | 51.4% | 44.6% | 16.8% | 4.9% | 2.5% |
| 20 | 64.3% | 51.0% | 24.0% | 4.9% | 3.1% |

According to the method for preventing and extinguishing fire of the present invention having such configuration, while a temperature rise of a combustible material is controlled due to the latent heat of vaporization of water composing foam of the fire-extinguishing agent composition, a fire due to burning of the pyrophoric substance or water prohibitive substance is smothered by the foam for controlling or extinguishing, and, a combustible material (including a pyrophoric substance or a water prohibitive substance, and partially chemically-converted these), which is a pyrophoric substance or a water prohibitive substances, is converted into an inert substance due to a hydration reaction, and fire prevention and fire extinction can be realized.

EXAMPLES

The method for preventing and extinguishing fire of the present invention above will be specifically described using examples and comparative examples below.

Examples 1 to 3

Triethylaluminium (TEAL) with the amounts shown in Table 2 was placed in a pan shown in Table 2 and ignited for burning.

The method for preventing and extinguishing fire of the present invention was implemented while the fire-extinguishing agent composition having a composition (a dilution rate was shown in Table 2) including protein hydrolysate, iron salt, glycol, surfactant and water was foamed, by hitting a retaining plate and supplying the fire-extinguishing agent composition. The fire extinguishing status on that occasion was visually evaluated, and the results were shown in Table 2.

Furthermore, the 20-min drain-off rate of the fire-extinguishing agent composition was measured according to "Expansion ratio of foam extinguishing equipment and measurement method for 25% reduction time" described on Page 31 of "Foam Head" (as of Oct. 1, 1997) published by Fire Equipment and Safety Center of Japan. The measurement results are shown in Table 2.

TABLE 2

| No. | Pan burned area | Fuel (kg) | Specifications of fire-extinguishing agent composition | Fire extinguishing method | Extinguishing status |
|---|---|---|---|---|---|
| Example 1 | 595 $cm^2$ | TEAL 0.34 | 20% dilution 20-min drain-off ratio 24.0% | Retaining plate method | No explosive reaction, and safely extinguished; no TEAL residue after fire extinction |
| Example 2 | 595 $cm^2$ | TEAL 0.34 | 30% dilution 20-min drain-off ratio 4.9% | Retaining plate method | No explosive reaction, and safely extinguished; no TEAL residue after fire extinction |
| Example 3 | 2,500 $cm^2$ | TEAL 0.9 | 30% dilution 20-min drain-off ratio 4.9% | Retaining plate method | No explosive reaction, and safely extinguished; no TEAL residue after fire extinction |

Comparative Examples 1 to 5

The method for preventing and extinguishing fire was implemented as similar to Example 1 except for using fire-extinguishing agents shown in Table 3 and using fire-extinguishing methods shown in Table 3. Evaluation results and measurement results were shown in Table 3.

TABLE 3

| No. | Pan burned area | Fuel (kg) | Specifications of fire-extinguishing agent composition | Fire extinguishing method | Extinguishing status |
|---|---|---|---|---|---|
| Comparative Example 1 | 78 $cm^2$ | TEAL 0.1 | Alkyl ex powder | Pouring with a scoop | A fire was extinguished while a flame was temporarily expanding to approximately two (2) meters; No TEAL remained after the fire extinction. |
| Comparative Example 2 | 78 $cm^2$ | TEAL 0.1 | Dried sand | Pouring with a scoop | No explosive reaction; a fire was safely extinguished even though it took time. If/when sands were removed after the fire extinction, the fire was ignited again. TEAL remained. |
| Comparative Example 3 | 78 $cm^2$ | TEAL 0.1 | Spray water | Spray emission | A fuel was scattered because of the explosive reaction, and this was a dangerous condition. |
| Comparative Example 4 | 595 $cm^2$ | TEAL 0.34 | 10% dilution 20-min drain-off ratio: 51% | Retaining plate method | A fuel was scattered because of the explosive reaction, and this was a dangerous condition. |
| Comparative Example 5 | 78 $cm^2$ | DEAC 0.004 | Alkyl ex powder | Pouring with a scoop | A fire was extinguished while a flame was temporarily expanding to approximately one (1) meters; No DEAC remained after the fire extinction. |

Examples 4 to 9

The method for preventing and extinguishing fire was implemented as similar to Example 1, except for using fire-extinguishing agents shown in Table 4 and using fire-extinguishing methods shown in Table 4. Evaluation results and measurement results were shown in Table 4.

TABLE 4

| No. | Pan burned area | Fuel (kg) | Specifications of fire-extinguishing agent composition | Fire extinguishing method | Extinguishing status |
|---|---|---|---|---|---|
| Example 4 | 20 $cm^2$ | TMAL 20 | 20% dilution 20-min drain-off ratio 4.9% | Foam was placed with a spatula. | No explosive reaction, and completely extinguished; no TMAL remained after the fire extinction |
| Example 5 | 20 $cm^2$ | DMZ 20 | 30% dilution 20-min drain-off ratio 4.9% | Foam was placed with a spatula. | No explosive reaction, and completely extinguished; no DM2 remained after the fire extinction |

TABLE 4-continued

| No. | Pan burned area | Fuel (kg) | Specifications of fire-extinguishing agent composition | Fire extinguishing method | Extinguishing status |
|---|---|---|---|---|---|
| Example 6 | 20 $cm^2$ | NaH 20 | 30% dilution 20-min drain-off ratio 4.9% | Foam was placed with a spatula. | No explosive reaction, and completely extinguished; no NaH remained after the fire extinction |
| Example 7 | 20 $cm^2$ | TMG composition 20 | 30% dilution 20-min drain-off ratio 4.9% | Foam was placed with a spatula. | No explosive reaction, and completely extinguished; no TMG remained after the fire extinction |
| Example 8 | 20 $cm^2$ | DIBAH composition 20 | 30% dilution 20-min drain-off ratio 4.9% | Foam was placed with a spatula. | No explosive reaction, and completely extinguished; no DIBAH remained after the fire extinction |
| Example 9 | 20 $cm^2$ | DEAC 20 | 30% dilution 20-min drain-off ratio 4.9% | Foam was placed with a spatula. | No explosive reaction, and completely extinguished; no DEAC remained after the fire extinction |

※ In tables:

TMAL: trimethylaluminium

DMZ: dimethyl zinc

TBB: tributylboron

NaH: sodium hydride

TMG composition: composition containing trimethyl gallium, dimethylaluminum chloride and mesitylene at a ratio by mass: 14.5:55.5:30

DIBAH composition: composition containing diiso-butylaluminum hydride and toluene at a ratio by mass: 17:83

DEAC: diethyl aluminum chloride

According to the result shown in Tables 2 to 4, if the method for preventing and extinguishing fire of the present invention is used, it becomes ascertained that a fire caused by a pyrophoric substances and water prohibitive substances can be effectively prevented and extinguished.

The invention claimed is:

1. A method for preventing and extinguishing fire, comprising:

preparing foam of a fire-extinguishing agent composition having a 20-min drain-off ratio of 30% or less, with air, and, supplying the foam to a fire due to burning of a combustible material, which is a pyrophoric substance or a water prohibitive substance, to convert the combustible material into an inert substance due to a hydration reaction, wherein the pyrophoric substance or the water prohibitive substance is an organic metallic compound or metal hydride having spontaneously combustibility or a water prohibitive property, or a compound containing the organic metallic compound or metal hydride.

2. The method for preventing and extinguishing fire according to claim 1, wherein the fire-extinguishing agent composition can generate the foam with 25% or less of 20-min drain-off ratio.

3. The method for preventing and extinguishing fire according to claim 1, wherein the fire-extinguishing agent composition can generate the foam with 5% or less of 20-min drain-off ratio.

4. The method for preventing and extinguishing fire according to claim 1, wherein temperature of the pyrophoric substance or water prohibitive substance after the fire-extinguishing agent composition is supplied is 100° C. or less.

* * * * *